US009481019B2

(12) United States Patent
Koak

(10) Patent No.: US 9,481,019 B2
(45) Date of Patent: Nov. 1, 2016

(54) BENDING MOLD FOR BENDING APPARATUS

(71) Applicant: LOESSM CO., LTD., Gyeonggi-do (KR)

(72) Inventor: Sounghoon Koak, Gimpo (KR)

( * ) Notice: Subject to any disclaimer, the term of this patent is extended or adjusted under 35 U.S.C. 154(b) by 68 days.

(21) Appl. No.: 14/407,062

(22) PCT Filed: Jun. 11, 2013

(86) PCT No.: PCT/KR2013/005150
§ 371 (c)(1),
(2) Date: Dec. 10, 2014

(87) PCT Pub. No.: WO2013/187678
PCT Pub. Date: Dec. 19, 2013

(65) Prior Publication Data

US 2015/0158070 A1 Jun. 11, 2015

(30) Foreign Application Priority Data

Jun. 12, 2012 (KR) ..... 10-2012-0062924

(51) Int. Cl.
*B21D 5/04* (2006.01)
*B21D 5/01* (2006.01)
*B21D 11/00* (2006.01)
*B21D 35/00* (2006.01)

(52) U.S. Cl.
CPC . *B21D 5/01* (2013.01); *B21D 5/04* (2013.01); *B21D 5/042* (2013.01); *B21D 11/00* (2013.01); *B21D 35/00* (2013.01)

(58) Field of Classification Search
CPC ..... B21D 5/04; B21D 11/00; B21D 35/00; B21D 5/042
USPC ..... 72/313
See application file for complete search history.

(56) References Cited

U.S. PATENT DOCUMENTS 4,002,049 A * 1/1977 Randolph, Sr. ..... B21D 35/00 72/313
4,520,646 A * 6/1985 Pauzin ..... B21D 5/04 72/313
5,123,270 A * 6/1992 Salvagnini ..... B21D 5/04 72/312
6,860,133 B2 * 3/2005 Kobayashi ..... B21D 11/00 72/313

FOREIGN PATENT DOCUMENTS

JP 07-164059 A 6/1995
JP 2000-024716 A 1/2000

(Continued)

OTHER PUBLICATIONS

International Search Report for PCT/KR2013/005150 mailed Oct. 17, 2013 from Korean Intellectual Property Office.

*Primary Examiner* — David B Jones
(74) *Attorney, Agent, or Firm* — Park, Kim & Suh, LLC

(57) ABSTRACT

A bending mold for a bending apparatus, the bending mold includes an upper mold; and a lower mold including a support member, a pressurizing member disposed on the support mold, having a metallic plate positioned thereon, and lowered by pressurization of the upper mold, an elastic member for providing an elastic force to the pressurizing member, and a bending member rotated at a predetermined angle by pressurization of the pressurizing member to bend the metallic plate placed on the pressurizing member.

13 Claims, 7 Drawing Sheets

(56) References Cited

FOREIGN PATENT DOCUMENTS

| | | | |
|---|---|---|---|
| JP | 2001-252721 | A | 9/2001 |
| JP | 2004-050186 | A | 2/2004 |
| KR | 10-0696590 | B1 | 3/2007 |
| KR | 10-0988161 | B1 | 10/2010 |

* cited by examiner

BENDING MOLD FOR BENDING APPARATUS

CROSS REFERENCE TO PRIOR APPLICATIONS

This application is a National Stage Application of PCT International Patent Application No. PCT/KR2013/005150 filed on Jun. 11, 2013, under 35 U.S.C. §371, which claims priority to Korean Patent Application No. 10-2012-0062924 filed on Jun. 12, 2012, the contents of all of which are incorporated herein by reference in their entirety.

BACKGROUND

The present invention relates to a bending mold for a bending apparatus, and more particularly, to a bending mold for a bending apparatus, for enhancing bending precision to remarkably reduce an inferiority rate and to also bend a thick metallic plate.

In general, a bending apparatus is used to bend a metallic plate to a desired shape and functions as a predetermined frame so as to install a bending mold thereon.

The bending mold installed on the bending apparatus includes an upper mold positioned above the bending mold and a lower mold positioned below the bending mold. The bending apparatus includes a pressurizer for moving up and down the upper mold and shaped like a cylinder using oil pressure or air pressure.

Thus, the metallic plate positioned on the lower mold is bent as the upper mold is moved up and down by the pressurizer and can be bent in various shapes according to the shapes of the upper mold and the lower mold. Typically, various shapes of bending molds are used according to a bending shape of the metallic plate to be bent.

As an example of the bending mold, Korean Patent No. 10-0988161 (hereinafter, referred to as the 'prior art') discloses a mold for a bending apparatus for vertically bending a metallic plate.

Referring to FIG. 1, the metallic plate according to the prior art includes an upper plate 1 and a lower plate 2, and the lower plate 2 includes a support member 3, a pressurizing member 4, a bending member 5, and a pressurizing plate 6. Thus, when the upper plate 1 is lowered and pressurizes the pressurizing member 4, the pressurizing member 4 is lowered and then pressurizes the pressurizing plate 6, and the metallic plate positioned on the pressurizing member 4 is bent while the bending member 5 is pressurized and is rotated.

The bending member 5 may be formed in various shapes. An example of a bending member according to the prior art is disclosed as illustrated in FIG. 2.

However, the mold according to the prior art has problems in that bending precision of the metallic plate is excessively degraded to cause a very high inferiority rate and in particular, the metallic plate is very irregularly bent. In addition, a problem also arises in that it is impossible to bend a thick metallic plate.

SUMMARY OF THE INVENTION

An object of the present invention devised to solve the problem lies in a bending mold for a bending apparatus, for enhancing bending precision to remarkably reduce an inferiority rate and to also bend a thick metallic plate.

The object of the present invention can be achieved by providing a bending mold for a bending apparatus, the bending mold including an upper mold and a lower mold including a support member, a pressurizing member disposed on the support mold, having a metallic plate positioned thereon, and lowered by pressurization of the upper mold, an elastic member fir providing an elastic force to the pressurizing member, and a bending member rotated at a predetermined angle by pressurization of the pressurizing member to bend the metallic plate placed on the pressurizing member, wherein the bending member includes a vertical portion and a horizontal portion that make an acute angle, a vertical support portion for supporting the vertical portion is disposed at one side of the support mold, and a support groove disposed at an internal lower portion of the vertical support portion, and a support portion protruding downward and supported by being inserted into the support groove is formed in a corner portion between the vertical portion and the horizontal portion.

Preferably, a contact surface of the support portion, which contacts a bottom surface of the support groove, may be a curved surface, and a step difference portion of the support groove may be curved with a predetermined curvature.

Preferably, a bending portion that is bent and extends in a horizontal direction may be formed at an end portion of the vertical portion so as to push and bend the metallic plate positioned on the pressurizing member when the bending member is rotated at a predetermined angle by pressurization of the pressurizing member, and a contact surface of the bending portion, which contacts the metallic plate, may be a curved surface.

Preferably, a contact portion convex upward may be formed at an end of the horizontal portion so as to be pressurized by the pressurizing member when the pressurizing member is lowered by pressurization of the upper mold, and a contact surface of the contact portion, which contacts the pressurizing member, may be a curved surface.

Preferably, the pressurizing member may include an upper portion having a metallic plate positioned thereon and a lower length portion extending downward from a predetermined portion of the upper portion, and an inclination surface that comes in contact with an end portion of the horizontal portion and restores the vertical portion to a vertical state when the pressurizing member is lifted by the elastic member, may be disposed on an external surface of the lower length portion at a side of the bending member. More preferably, a contact surface of the end portion, which contacts the inclination surface, may be a curved surface.

An internal side surface of the corner portion may be a curved surface. In this case, a lower corner portion of the upper portion at a side of the bending member may be curved with a predetermined curvature.

The upper portion may include a left length portion having a predetermined length toward the bending member based on the lower length portion and a right length portion having a predetermined length toward an opposite side to the bending member, a bottom surface of the right length portion may be flat, the support mold may include a compression portion facing the right length portion and being flat, and the right length portion may be formed to be longer than the left length portion. More preferably, an accommodation groove may be formed at a corner portion between the right length portion and the lower length portion.

A bending molding according to the present invention may enhance bending precision to remarkably reduce an inferiority rate and to also bend a thick metallic plate, compared with a bending mode according to the prior art.

DETAILED DESCRIPTION

Figure 1:
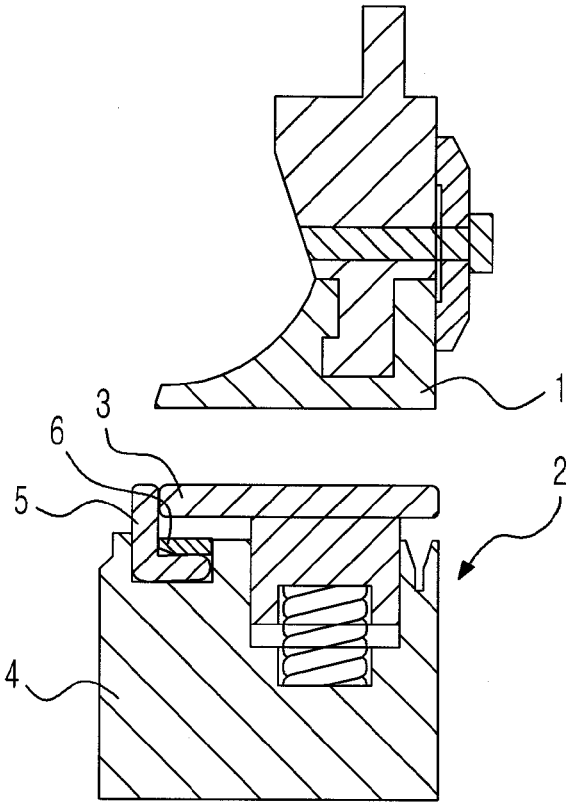
FIG. 1 Prior Art
FIG. 1 is a diagram illustrating a bending mold according to the prior art.

The present invention will now be described more fully with reference to the accompanying drawings, in which exemplary embodiments of the invention are shown.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention.

Through this specification, spatially relative terms, such as 'vertical', 'horizontal', 'left', 'right', and the like, may be used herein for describe a relationship between elements based on directions illustrated in the drawings and no limitation of the scope of the invention is intended by these terms.

In the drawings, thicknesses and sizes of elements are may be exaggerated for clarity. Thus, no limitation of the scope of the invention is intended by the relative sizes or thicknesses illustrated in the drawings.

The present invention is obtained by improving a bending mold disclosed in the prior art (Korean Patent No. 10-0988161) and relates to a bending mold for a bending apparatus for enhancing bending precision to remarkably reduce an inferiority rate and to also bend a thick metallic plate, compared with the prior art.

Figure 3:
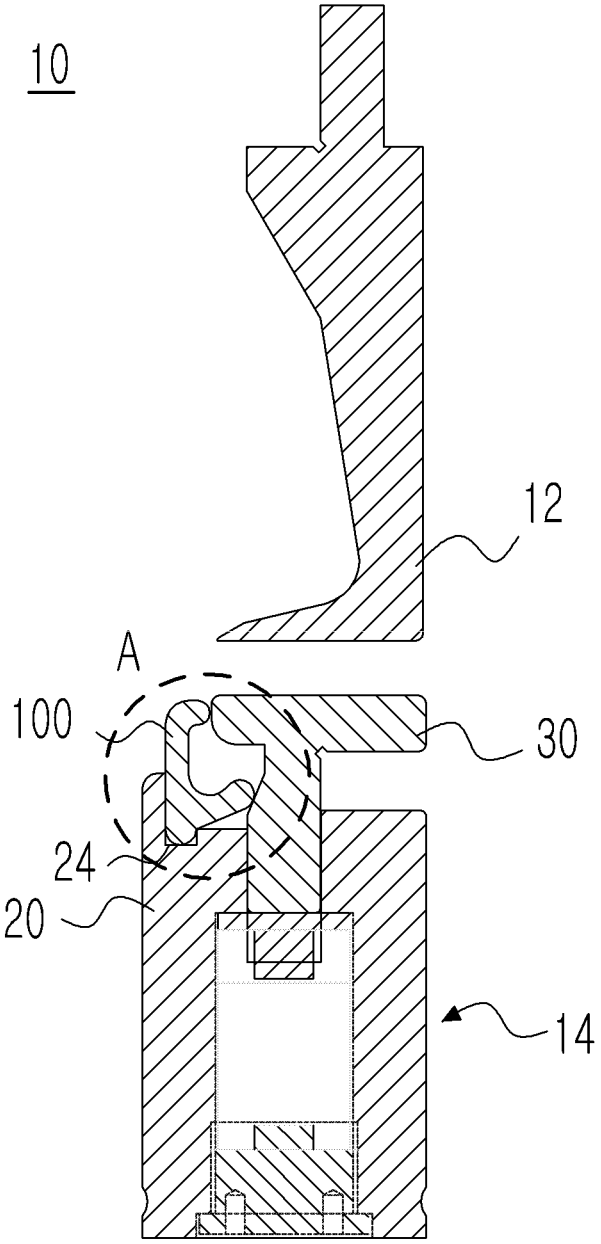
FIG. 3 is a schematic cross-sectional view of a bending mold according to the present invention.

FIG. 3 is a cross-sectional view of a bending mold 10 for a bending apparatus according to the present invention.

Referring to FIG. 3, the bending mold 10 according to the present invention includes an upper mold 12 positioned on the bending apparatus and moved up and down, and a lower mold 14 positioned below the bending apparatus and for positioning the metallic plate thereon.

The lower mold 14 includes a support mold 20, a pressurizing member 30 that is disposed on the support mold 20, has a metallic plate positioned thereon, and is lowered by pressurization of the upper mold 12, an elastic member for providing an elastic force to the pressurizing member 30, and a bending member 100 that is rotated by pressurization of the pressurizing member 30 at a predetermined angle to bend the metallic plate positioned on the pressurizing member 30.

Although not illustrated in FIG. 3, the elastic member may be configured in the form of a spring disposed between the support mold 20 and the pressurizing member 30.

Figure 4:
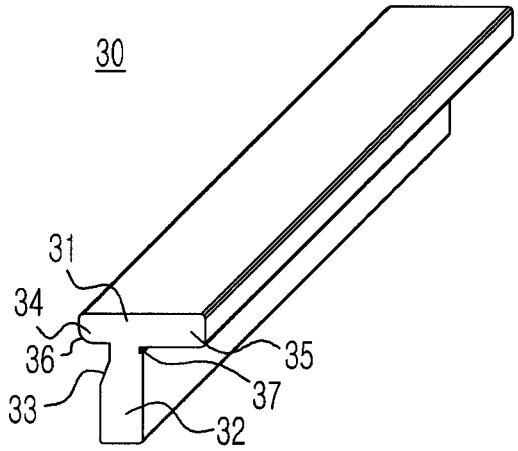
FIG. 4 is a perspective view of a pressurizing member according to the present invention.

FIG. 4 is a perspective view of the pressurizing member 30 according to the present invention.

Referring to FIG. 4, the pressurizing member 30 according to the present invention may be formed in a longitudinal direction and includes an upper portion 31 having a metallic plate positioned thereon, and a lower length portion 32 extending downward from a predetermined portion of the upper portion 31.

An inclination surface 33 may be disposed to be tapered upward on an external surface of the lower length portion 32 at a side of the bending member 100. The upper portion 31 may include a left length portion 34 having a predetermined length toward the bending member 100 based on the lower length portion 32 and a right length portion 35 having a predetermined length toward an opposite side to the bending member 100. A lower corner portion 36 of the upper portion 31 of the pressurizing member 30 at a side of the bending member 100 may be curved with a predetermined curvature. In addition, an accommodation groove 37 may be formed at a corner portion between the right length portion 35 and the lower length portion 32.

Figure 5:
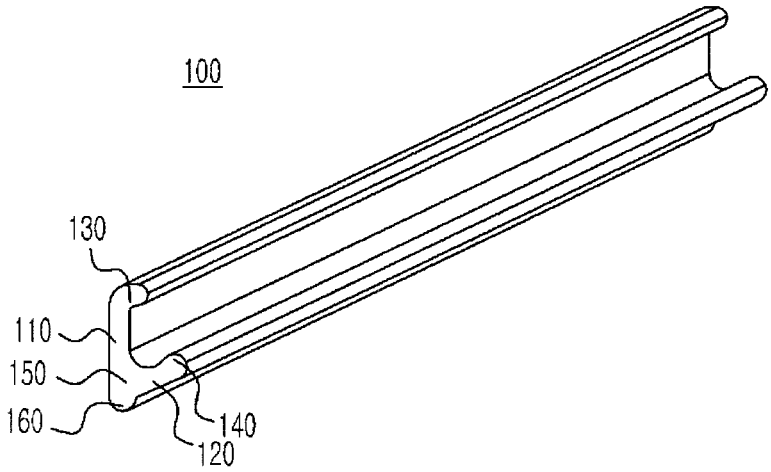
FIG. 5 is a perspective view of a bending member according to the present invention.

FIG. 5 is a perspective view of the bending member 100 according to the present invention.

Referring to FIG. 5, the bending member 100 according to the present invention may be longitudinally formed in a longitudinal direction and may include a vertical portion 110 and a horizontal portion 120 that make an acute angle.

A bending portion 130 may be bent to extend in a horizontal direction at an end portion of the vertical portion 110, a contact portion 140 may be convex upward at an end portion of the horizontal portion 120, and a support portion 160 protruding downward may be formed at a corner portion 150 between the vertical portion 110 and the horizontal portion 120.

Figure 6:
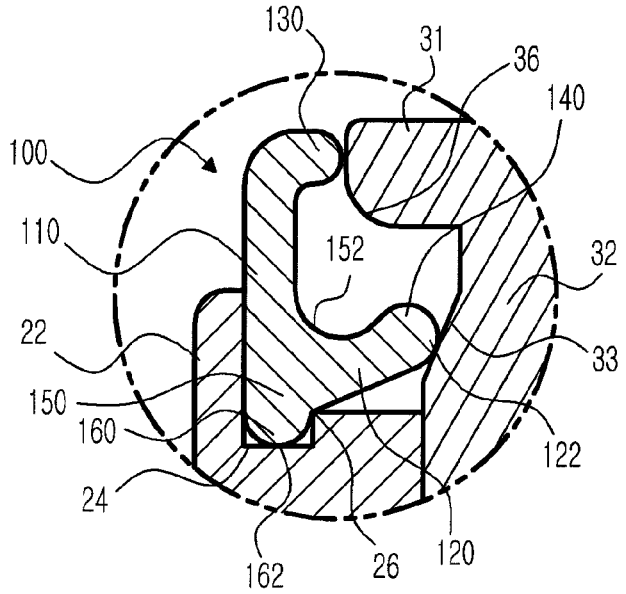
FIG. 6 is an enlarged view of a portion 'A' of FIG. 3.
Figure 7:
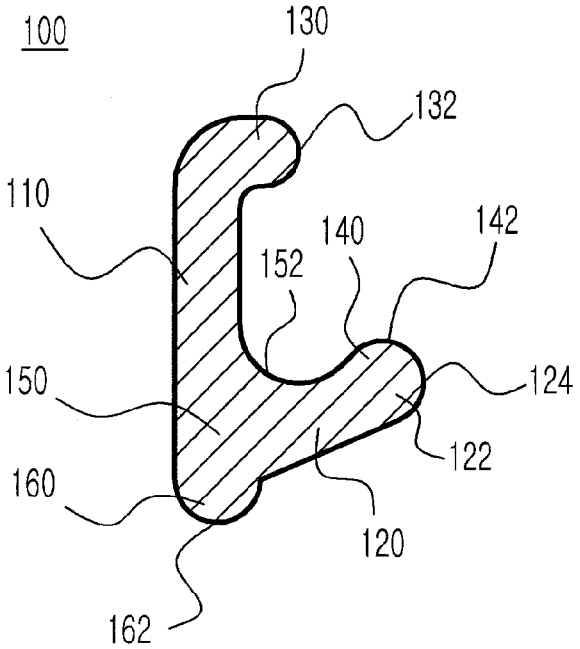
FIG. 7 is a cross-sectional view of the bending member of FIG. 5.

FIG. 6 is an enlarged view of a portion 'A' of FIG. 3. FIG. 7 is a cross-sectional view of the bending member 100 according to the present invention. Hereinafter, the components will be described in detail with reference to FIGS. 6 and 7.

Since the bending member 100 includes the vertical portion 110 and the horizontal portion 120 that make an acute angle, when the vertical portion 110 is approximately vertically positioned, the horizontal portion 120 is inclined upward at a predetermined angle and thus is maintained to be spaced apart from a bottom surface by a predetermined interval. Accordingly, when the pressurizing member 30 is lowered to pressurize the horizontal portion 120, the vertical portion 110 may be rotated at a predetermined angle.

The bending portion 130 that is bent to extend to a horizontal direction may be formed at an end portion of the vertical portion 110 and may push and bend a bending portion of a metallic plate, which is positioned on the pressurizing member 30 when the bending member 100 is rotated at a predetermined angle by pressurization of the pressurizing member 30.

Accordingly, the bending mold 10 according to the present invention is configured in such a way that, when the upper mold 12 is lowered and pressurizes the pressurizing member 30, the pressurizing member 30 is lowered and then pressurizes the horizontal portion 120 of the bending member 100, and the bending portion 130 pushes the bending portion of the metallic plate, positioned on the pressurizing member 30, and bends the metallic plate while the vertical portion 110 of the bending member 100 is rotated.

In addition, when the upper mold 12 is re-lifted, the pressurizing member 30 is also re-lifted by the elastic member. Thus, the bending member 100 is rotated in an opposite direction to return back to an original state, and in other words, the vertical portion 110 returns to a vertical state and the horizontal portion 120 returns to be spaced apart from a bottom surface by a predetermined interval. Accordingly, the bending mold 10 returns to a preparation state for another bending operation.

A vertical support portion 22 for supporting the vertical portion 110 may be formed at one side thereof, a support groove 24 may be formed at an internal lower portion of the vertical support portion 22, and the support portion 160 may be formed at the corner portion 150 between the vertical portion 110 and the horizontal portion 120 to protrude downward and may be inserted into the support groove 24 so as to be supported. Compared with the prior art (Korean Patent No. 10-0988161), this configuration according to the present invention may enhance bending precision to remarkably reduce an inferiority rate.

The inventor of the present application also invented the bending mold according to the prior art. As the result of efforts to overcome the problem of the bending mold disclosed in the prior art, the following conclusion can be achieved. In other words, the bending mold according to the prior art irregularly bends a metallic plate due to very low bending precision to cause a very high inferiority rate. In this regard, the present inventor has discovered that this problem is caused due to back-lash of the bending member 100.

Figure 8:
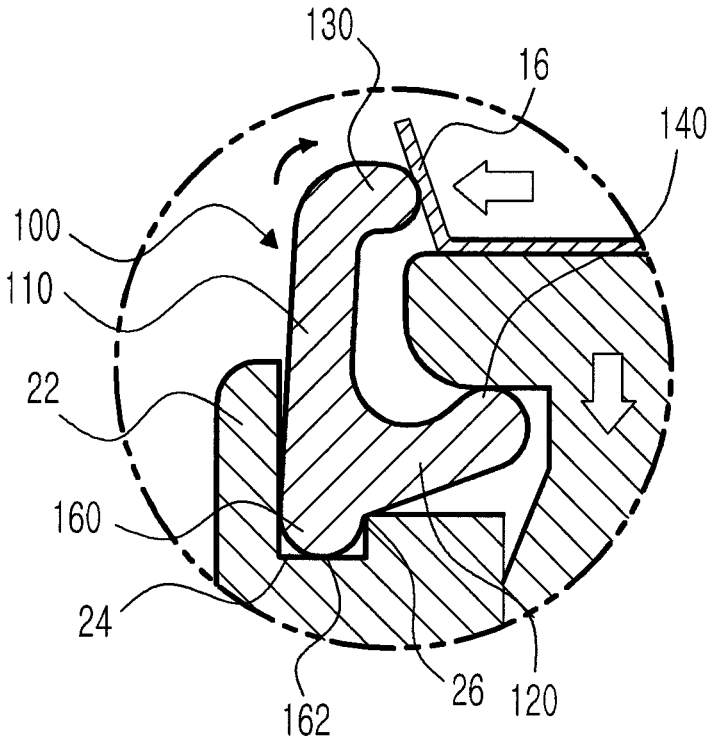
FIG. 8 is a diagram for explanation of back-lash of a bending mold according to the present invention.

FIG. 8 is a diagram for explanation of back-lash that occurs during a bending operation of the bending mold 10 according to the present invention.

As illustrated in FIG. 8, when the bending member 100 is rotated such that the bending portion 130 pushes a bending portion of a metallic plate 16, a strong force is applied to the bending mold 10 according to the present invention from the metallic plate 16 in an opposite direction to the rotation. Thus, the bending member 100 is moved backward, and that is, back-lash of the bending member 100 occurs. Back-lash of the bending member 100 is more serious as the thickness of the metallic plate 16 to be bent is increased.

When the bending mold according to the prior art is used, the bending member 5 is moved backward or shaken due to back-lash, bending precision for pushing a metallic plate is seriously degraded. In particular, like the bending mold according to the present invention, when the bending portion 130 pushes the bending portion of the metallic plate 16 while the bending member 100 is rotated, the slight shake of the bending member 100 may largely affect the bending precision, and thus a problem arises in that the bending portion of the metallic plate may become irregular and uneven.

However, like in the bending mold 10 according to the present invention, when the support groove 24 is formed in the support mold 20 and the support portion 160 is formed at the bending member 100 and inserted into the support groove 24 so as to be supported, the bending member 100 is not moved back or shaken due to back-lash of the bending member 100 despite high resistance by the metallic plate 16 during bending, thereby enhancing the bending precision of the metallic plate 16. In reality, the present inventor can remarkably reduce an inferiority rate of a metallic plate using the above configuration.

When the above configuration according to the present invention is used, a thick metallic plate can also be bent. Since a thick metallic plate has high resistance, the bending mold according to the prior art cannot bend the thick metallic plate, but the bending mold 10 according to the present invention can also precisely bend the thick metallic plate.

Preferably, a contact surface 162 of the support portion 160, which contacts a lower surface of the support groove 24, may be a curved surface. For example, the support portion 160 may have a semicircular shape as a vertical sectional view such that the contact surface 162 is shaped like an approximate circle, and the support groove 24 may have a width and depth corresponding to a radius of the semicircle.

The contact surface 162 of the support portion 160 functions as a center of rotation when the bending member 100 is rotated, and thus when the contact surface 162 of the support portion 160 is a curved surface, the bending member 100 may be more smoothly rotated. This configuration may further enhance bending precision and may also reduce resistance applied to the bending member 100, and thus back-lash of the bending member 100 may be further reduced so as to further enhance bending precision.

More preferably, a step difference portion 26 formed at an opposite side to the vertical support portion 22 of the support groove 24 may be curved with a predetermined curvature. The step difference portion 26 contacts one surface of the horizontal portion 120, and thus when the step difference portion 26 is curved with a predetermined curvature, interference between the step difference portion 26 and the horizontal portion 120 may be minimized so as to more smoothly rotate the bending member 100, thereby further enhancing bending precision.

Figure 2:
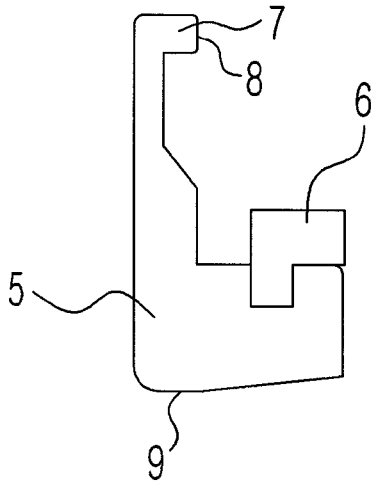
FIG. 2 Prior Art
FIG. 2 is a diagram illustrating a bending member according to the prior art.

The present inventor discovered that high resistance is applied to the bending member 5 by a metallic plate due to a shape of a bending portion of the bending member 5 according to the prior art shown in FIG. 2 to cause higher back-lash of the bending member 5 and to scratch the metallic plate, which further increase an inferiority rate of the bent metallic plate.

During research into solutions to the above issue, the present inventor has resolved the above issue, that is, more serious back-lash and scratched bending portion of the metallic plate by forming a curved surface as a contact surface 132 of the bending portion 130, which contacts the metallic plate, which will be described in detail with reference to the following diagrams.

Figure 9:
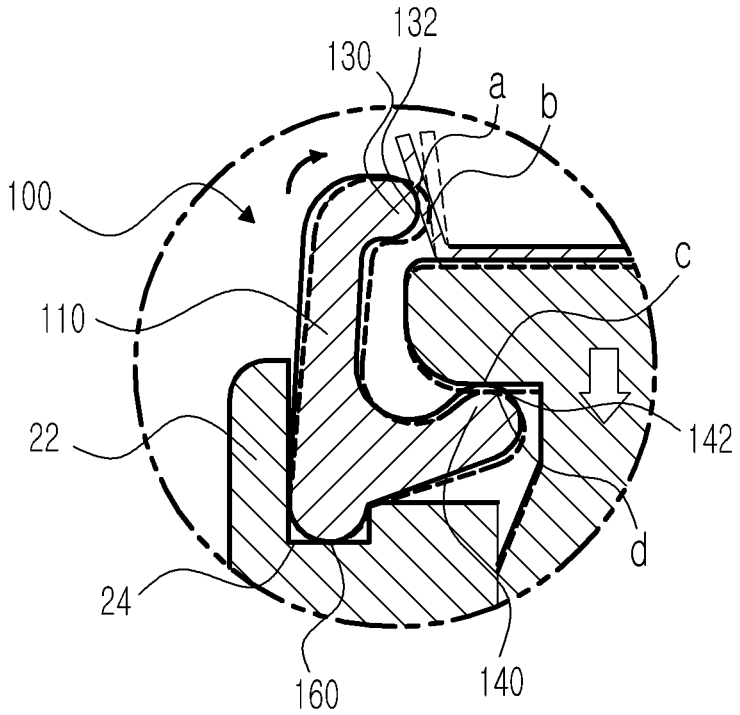
FIG. 9 is a diagram of a state in which contact points of a bending portion, which contact a metallic plate, are changed as a bending member is rotated.

FIG. 9 is a diagram of a state in which contact points of the bending portion 130, which contact a metallic plate, are changed as the bending member 100 is rotated.

As illustrated in FIG. 9, when the bending member 100 is rotated and the bending portion 130 pushes the bending portion 130 of the metallic plate 16, the contact points a and b of the bending portion 130, which contact the metallic plate 16, are continuously changed. This is because the contact surface 132 of the bending portion 130 pushes the bending portion 130 of the metallic plate 16 while drawing an imaginary approximate circular shape along with rotation of the bending member 100, whereas a bending angle of the metallic plate 16 is gradually increased. That is, along with rotation of the bending member 100, the contact points a and b that directly contact the metallic plate 16 are continuously changed and the contact surface 132 of the bending portion 130 pushes and bends the metallic plate 16 while drawing an imaginary approximate circular shape.

However, as illustrated in FIG. 2, since the bending member 5 according to the prior art is configured in such a way that a contact surface 8 of a bending portion 7 has an angular shape including an approximate rectangular sectional view, a contact point that directly contacts the metallic plate may not be changed along with rotation of the bending member 5. Thus, resistance and frictional force applied to one contact point are increased, and then resistance applied to the overall bending member 5 is seriously increased and the bending portion of the metallic plate is also scratched.

On the other hand, when the contact surface 132 of the bending portion 130 is curved like in the bending mold 10 according to the present invention, the contact points a and b may be smoothly changed along with the bending member 100, the issue of the prior art may be resolved. The contact surface 132 may have any curved shape and preferably, have an approximate circular shape. This is because, along with rotation of the bending member 100, the contact surface 132 comes in contact with the metallic plate 16 while drawing an imaginary approximate circular shape.

As illustrated in FIGS. 1 and 2, the bending mold according to the prior art further includes the pressurizing plate 6 that directly contacts and is pressurized by the pressurizing member 4. According to this configuration, the pressurization by the pressurizing member 4 cannot be uniformly applied to the bending member 5 and thus it is difficult to uniformly and smoothly rotate the overall bending member 5, which is one reason to irregularly bend the metallic plate.

Accordingly, in order to overcome this problem, the bending mold 10 according to the present invention may be configured in such a way that the contact portion 140 that is convex upward is formed at an end of the horizontal portion 120 of the bending member 100 so as to directly contact the pressurizing member 30 and to be pressurized by the pressurizing member 30 when the pressurizing member 30 is lowered.

That is, the bending mold 10 according to the present invention is configured in such a way that the contact portion 140 that directly contacts the pressurizing member 30 and is pressurized by the pressurizing member 30 is integrally formed with the bending member 100. As such, when the contact portion 140 that is convex upward is integrally formed with the bending member 100 at an end of the horizontal portion 120, pressurization of the pressurizing member 30 can be uniformly and smoothly transmitted to the overall bending member 100, and thus the overall bending member 100 may be more smoothly rotated, thereby further enhancing bending precision.

Preferably, a contact surface 142 of the contact portion 140, which contacts the pressurizing member 30, may be a curved surface. As illustrated in FIG. 9, when the bending member 100 is rotated, the contact surface 132 that directly contacts the pressurizing member 30 comes in contact with the pressurizing member 30 while drawing an imaginary approximate circular shape and contact points c and d are continuously changed, and thus when the contact surface 132 is a curved surface, pressurization due to contact with the pressurizing member 30 may be more uniformly and smoothly performed. The contact surface 142 may have any curved shape and preferably, have an approximate circular shape.

Like in the bending mold 10 according to the present invention, when the bending portion 130 pushes and bends the bending portion of the metallic plate along with rotation of the bending member 100, the vertical portion 110 of the bending member 100 needs to be maintained in a vertical state before being pressurized by the pressurizing member 30 and one side of the horizontal portion 120 needs to be spaced apart from a bottom surface by a predetermined interval in order to further enhance the bending precision of the metallic plate to further reduce an inferiority rate.

According to the prior art, in consideration of this point, the bending member 5 is used to be maintained in a vertical state using one lower side 9 as a gravity center. In this regard, despite this configuration, a problem arises in that the bending member 5 is not restored to a vertical state after one time bending operation.

That is, when the bending mold 10 according to the present invention is configured in such a way that the bending member 5 is restored to an original state after bending the metallic plate along with rotation of the bending member 5, a next bending operation can be smoothly performed, and when the bending member 5 is not automatically restored to a vertical state after a bending operation, next bending precision is seriously degraded, thereby increasing an inferiority rate.

Thus, in order to overcome this problem, the bending mold 10 according to the present invention may include the inclination surface 33 that is included in the pressurizing member 30 so as to support the bending member 100 to be maintained in a vertical state as usual and to restore the bending member 100 back to the original state after the bending operation.

Figure 10:
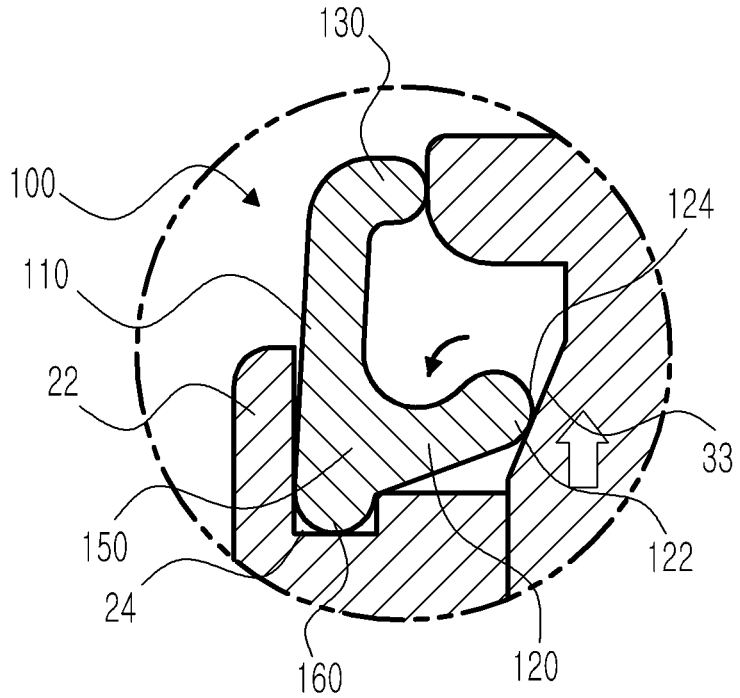
FIG. 10 is a diagram for explanation of a process for restoring a bending member back to an original state when a pressurizing member is lifted.

FIG. 10 is a diagram for explanation of a process for restoring the bending member 100 back to an original state when the pressurizing member 30 is lifted.

As illustrated in FIG. 10, the inclination surface 33 may be disposed to be tapered upward on an external surface of the lower length portion 32 at a side of the bending member 100, and may come in contact with an end portion 122 of the horizontal portion 120 and restore the vertical portion 110 to a vertical state when the pressurizing member 30 is lifted by an elastic member.

By virtue of the inclination surface 33, the end portion 122 of the horizontal portion 120 may be supported by the inclination surface 33 so as to maintain the vertical portion 110 in a vertical state as usual, and the end portion 122 of the horizontal portion 120 may come in contact with the inclination surface 33 and the vertical portion 110 may be restored to a vertical state while being oppositely rotated as the pressurizing member 30 is lifted after the bending operation.

Preferably, a contact surface 124 of the end portion 122, which contacts the inclination surface 33, may be a curved surface. As such, when the contact surface 124 is a curved surface, since contact points of the contact surface 124, which contacts the inclination surface 33, can be smoothly changed along with rotation of the bending member 100, the bending member 100 can be smoothly rotated. The contact surface 124 may have any curved shape and preferably, have an approximate circular shape.

An internal side surface 152 of the corner portion 150 of the bending member 100 according to the present invention may be a curved surface. As such, when the internal side surface 152 of the corner portion 150 is a curved surface, in particular, an approximate circular shape, strength of the bending member 100 that pushes the metallic plate can be increased so as to achieve uniform bending, thereby minimizing interference with the pressurizing member 30.

More preferably, the lower corner portion 36 at a side of the bending member 100 of the upper portion 31 of the pressurizing member 30 may be curved with a predetermined curvature. Thus, as the pressurizing member 30 is moved up and down, interference of the pressurizing member 30 and the bending member 100, in particular, the lower corner portion 36 and the corner portion 150 with the internal side surface 152 can be minimized.

Figure 11:
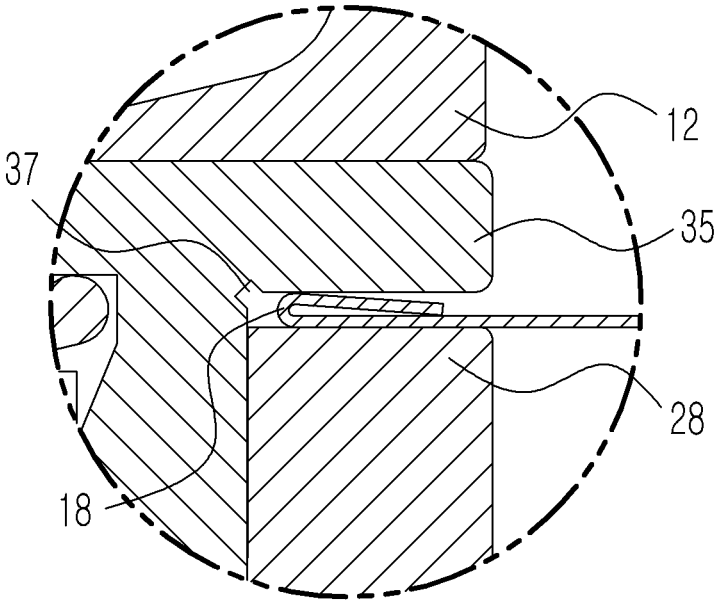
FIG. 11 is a diagram for explanation of an operation of bending a metallic plate at a predetermined angle to compress two facing surfaces using a bending mold according to the present invention.

The bending mold 10 according to the present invention may be configured so as to be bent to compress two facing surfaces separately from the aforementioned operation FIG. 11 is a diagram for explanation of an operation of bending a metallic plate at a predetermined angle to compress two facing surfaces using a bending mold according to the present invention.

As illustrated in FIG. 11, the upper portion 31 of the pressurizing member 30 may include the left length portion 34 having a predetermined length toward the bending member 100 based on the lower length portion 32 and the right length portion 35 having a predetermined length toward an opposite side to the bending member 100. The right length portion 35 may be formed to be longer than the left length portion 34 and a bottom surface of the right length portion 35 may be flat. In addition, the support mold 20 may include a compression portion 28 that faces the right length portion 35 and is flat. According to this configuration, the operation of compressing a bent surface to another surface can be easily performed.

Preferably, the accommodation groove 37 may be disposed at a corner portion between the right length portion 35 and the lower length portion 32. As illustrated in FIG. 11, when a bent surface is compressed to another facing surface, a bending edge portion 18 of the bent surface may become convex. In this regard, the accommodation groove 37 may provide a space for accommodation of the convex bending edge portion 18 so as to minimize interference due to the convex bending edge portion 18.

As described above, the present invention relates to a bending mold for a bending apparatus that can remarkably reduce an inferiority rate by enhancing bending precision and can also bend a thick metallic plate by improving the bending mold disclosed in the prior art (Korean Patent No. 10-0988161). It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

A bending mold according to the present invention is obtained by improving a bending molding according to the prior art and enhances bending precision compared with the prior art so as to remarkably reduce an inferiority rate. Accordingly, the bending mold according to the present invention is expected to be widely used in the future, whereas use of the bending molding according to the prior art is limited due to problems of the bending molding according to the prior art. In particular, the bending mold according to the present invention is expected to replace a foreign expensive device that has been used to bend a metallic plate at a right angle by internal bending companies, and thus profits of the internal bending companies are also expected to increase. In addition, the bending mold according to the present invention is very inexpensive and has competitive performance to a foreign expensive device, and thus is expected to cause a considerable change in overseas bending industry as well as in internal bending industry.

The invention claimed is:

1. A bending mold for a bending apparatus, the bending mold comprising: an upper mold; and a lower mold comprising a support member, a pressurizing member disposed on the support mold, having a metallic plate positioned thereon, and lowered by pressurization of the upper mold, and a bending member rotated at a predetermined angle by pressurization of the pressurizing member to bend the metallic plate placed on the pressurizing member, wherein:

the bending member comprises a vertical portion and a horizontal portion that make an acute angle, a vertical support portion for supporting the vertical portion is disposed at one side of the support mold, and a support groove disposed at an internal lower portion of the vertical support portion; and a support portion protruding downward and supported by being inserted into the support groove is formed in a corner portion between the vertical portion and the horizontal portion, wherein:

a contact portion convex upward is formed at an end of the horizontal portion so as to be pressurized by the pressurizing member when the pressurizing member is lowered by pressurization of the upper mold; and a contact surface of the contact portion, which contacts the pressurizing member, is a curved surface.

2. The bending mold according to claim 1, wherein a contact surface of the support portion, which contacts a bottom surface of the support groove, is a curved surface.

3. The bending mold according to claim 2, wherein a step difference portion of the support groove is curved with a predetermined curvature.

4. The bending mold according to claim 1, wherein:

a bending portion that is bent and extends in a horizontal direction is formed at an end portion of the vertical portion so as to push and bend the metallic plate positioned on the pressurizing member when the bending member is rotated at a predetermined angle by pressurization of the pressurizing member; and a contact surface of the bending portion, which contacts the metallic plate, is a curved surface.

5. The bending mold according to claim 1, wherein an internal side surface of the corner portion is a curved surface.

6. The bending mold according to claim 1, wherein:

the pressurizing member comprises an upper portion having a metallic plate positioned thereon and a lower length portion extending downward from a predetermined portion of the upper portion; and an inclination surface that comes in contact with an end portion of the horizontal portion and restores the vertical portion to a vertical state when the pressurizing member is lifted, is disposed on an external surface of the lower length portion at a side of the bending member.

7. The bending mold according to claim 6, wherein a contact surface of the end portion, which contacts the inclination surface, is a curved surface.

8. The bending mold according to claim 6, wherein a lower corner portion of the upper portion at a side of the bending member is curved with a predetermined curvature.

9. The bending mold according to claim 6, wherein:

the upper portion comprises a left length portion having a predetermined length toward the bending member based on the lower length portion and a right length portion having a predetermined length toward an opposite side to the bending member;

a bottom surface of the right length portion is flat;

the support mold comprises a compression portion facing the right length portion and being flat; and the right length portion is formed to be longer than the left length portion.

10. A bending mold for a bending apparatus, the bending mold comprising: an upper mold; and a lower mold comprising a support member, a pressurizing member disposed on the support mold, having a metallic plate positioned thereon, and lowered by pressurization of the upper mold, and a bending member rotated at a predetermined angle by pressurization of the pressurizing member to bend the metallic plate placed on the pressurizing member, wherein:

the bending member comprises a vertical portion and a horizontal portion that make an acute angle, a vertical support portion for supporting the vertical portion is disposed at one side of the support mold, and a support groove disposed at an internal lower portion of the vertical support portion; and a support portion protruding downward and supported by being inserted into the support groove is formed in a corner portion between the vertical portion and the horizontal portion, wherein:

the pressurizing member comprises an upper portion having a metallic plate positioned thereon and a lower length portion extending downward from a predetermined portion of the upper portion; and an inclination surface that comes in contact with an end portion of the horizontal portion and restores the vertical portion to a vertical state when the pressurizing member is lifted, is disposed on an external surface of the lower length portion at a side of the bending member.

11. The bending mold according to claim 10, wherein a contact surface of the end portion, which contacts the inclination surface, is a curved surface.

12. The bending mold according to claim 10, wherein a lower corner portion of the upper portion at a side of the bending member is curved with a predetermined curvature.

13. The bending mold according to claim 10, wherein:

the upper portion comprises a left length portion having a predetermined length toward the bending member based on the lower length portion and a right length portion having a predetermined length toward an opposite side to the bending member;

a bottom surface of the right length portion is flat;

the support mold comprises a compression portion facing the right length portion and being flat; and the right length portion is formed to be longer than the left length portion.

* * * * *